US006267607B1

(12) United States Patent
Fitch et al.

(10) Patent No.: US 6,267,607 B1
(45) Date of Patent: Jul. 31, 2001

(54) ANTI-ROTATION GROUND CLIP FOR FACEPLATES

(75) Inventors: Dennis J. Fitch, Batavia, IL (US); Eric T. Sexton, Budd Lake; Girard Sidone, Hamilton Township, both of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/447,773

(22) Filed: Nov. 23, 1999

(51) Int. Cl.[7] ..... H01R 4/66
(52) U.S. Cl. ..... 439/92; 439/108
(58) Field of Search ..... 439/108, 92, 95; 211/41.17; 361/800, 799, 816

(56) References Cited

U.S. PATENT DOCUMENTS 5,452,184 * 9/1995 Scholder et al. ..... 361/799
5,513,996 * 5/1996 Annerino et al. ..... 439/95
5,647,748 * 7/1997 Mills et al. ..... 439/81
6,017,226 * 1/2000 Jeffries et al. ..... 439/92
6,074,251 * 6/2000 Edgerly et al. ..... 439/610
6,089,882 * 7/2000 Costello ..... 439/95

* cited by examiner

*Primary Examiner*—Brian Sircus
*Assistant Examiner*—Chandrika Prasad
(74) *Attorney, Agent, or Firm*—Duane, Morris & Heckscher LLP

(57) ABSTRACT

A face plate assembly includes a ground clip that is mounted to a face plate which is coupled to a circuit pack. The ground clip includes a base member, a contact surface and a free end. The ground clip is mounted to a flange provided on the faceplate. The flange includes a cutout, wherein the free end of the ground clip is received in the cutout for preventing rotation of the ground clip. The ground clip may include a first elbow connecting the base to the contact surface and a second elbow connecting the contact surface to the free end. A Z-bend may also be provided in the contact surface of ground clip.

13 Claims, 6 Drawing Sheets

ANTI-ROTATION GROUND CLIP FOR FACEPLATES

FIELD OF THE INVENTION

The invention relates generally to electrostatic discharge devices for telecommunications equipment.

BACKGROUND OF THE INVENTION

A telecommunications eletrostatic discharge (ESD) requirement states that there should be no floating metal on a circuit pack. Floating metal acts as an antenna during an ESD discharge event. In addition, a floating piece of metal may contribute to a more severe secondary discharge. Floating metal can also be an electrical safety hazard. Therefore, a metal panel (faceplate) attached to a circuit pack must be grounded to earth when inserted into a subrack. The grounded faceplate also provides a path to ground from the ground layer of the circuit board.

FIG. 1. shows a conventional face plate assembly having a ground clip 12 that provides a ground path from the faceplate assembly to the subrack frame ground. The ground clip 12 is riveted to a metal face plate 60 attached to a circuit pack 80. A single rivet 13 secures the first end or base 14 of the ground clip to the face plate 60, while the opposite or free end 15 of the ground clip 12 is free to rotate about the axis of the rivet 13. The ground clip 12 includes a contact surface 16 that is offset from an axis of the rivet 13. The contact surface 16 is compliant in that it deflects downward as the circuit pack 80 is inserted in the subrack. Forces imparted on the contact surface 16 during insertion and extraction of the circuit pack 80 from the subrack 16 can cause the ground clip 12 to rotate or become skewed with respect to the face plate 60. If the ground clip becomes misaligned it can snag adjacent components, impairing the operability of the system.

Accordingly, improved apparatus and methods for grounding the face plates of circuit packs are desirable.

SUMMARY OF THE INVENTION

The invention provides a face plate assembly including a ground clip that is mounted to a face plate which is coupled to a circuit pack. The ground clip includes a base member, a contact surface and a free end. The ground clip is mounted to a flange provided on the faceplate. The flange includes a cutout, wherein the free end of the ground clip is received in the cutout for preventing rotation of the ground clip.

BRIEF DESCRIPTION OF THE DRAWINGS

These and other features and advantages of the invention are more fully disclosed or rendered apparent from the following description of certain preferred embodiments of the invention, that are to be considered together with the accompanying drawings wherein like numbers refer to like parts and further wherein.

DETAILED DESCRIPTION

Figure 1:
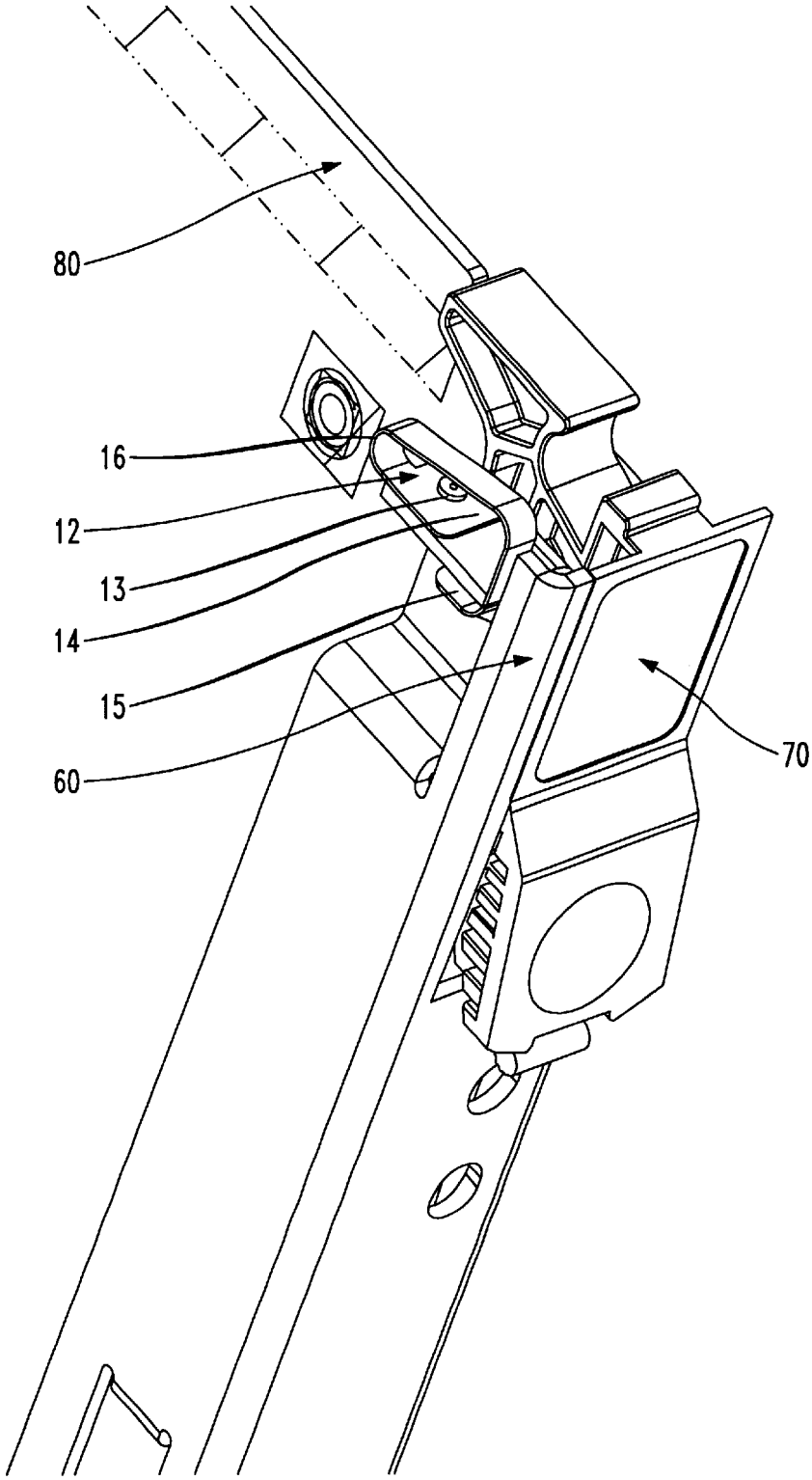
FIG. 1 is an isometric view of a face plate assembly in accordance with the prior art.
Figure 2:
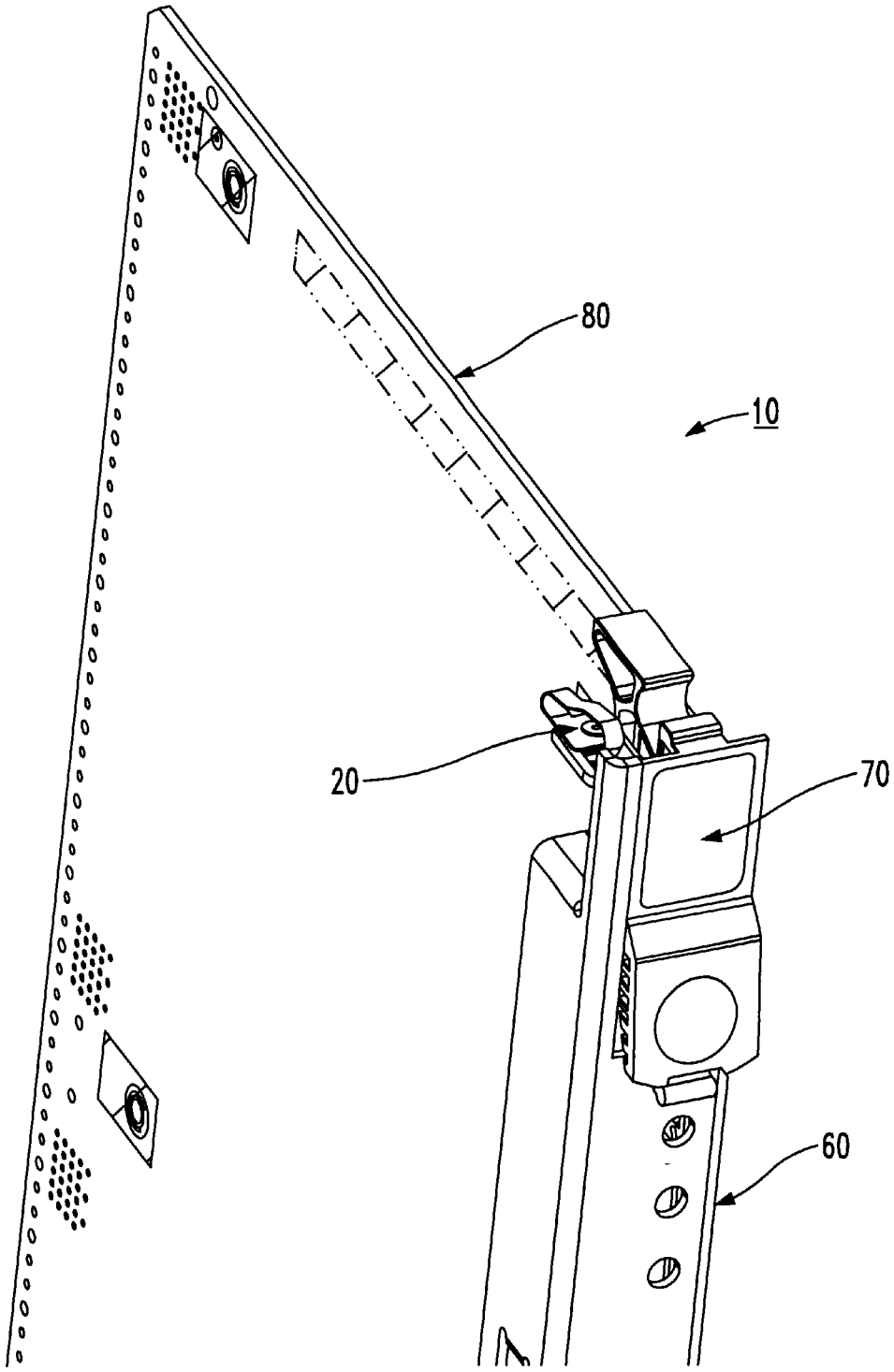
FIG. 2 is an isometric view of a face plate assembly in accordance with the invention.

FIG. 2 shows a face plate assembly 10 in accordance with the invention. The assembly 10 includes a ground clip 20 mounted on a face plate 60 that is secured to a printed wiring board 80, also known as a circuit pack. The ground clip 20 is secured to face plate 60 in a manner that prevents ground clip 20 from rotating with respect to face plate 60 when the assembly 10 is inserted or removed from a subrack.

Figure 3:
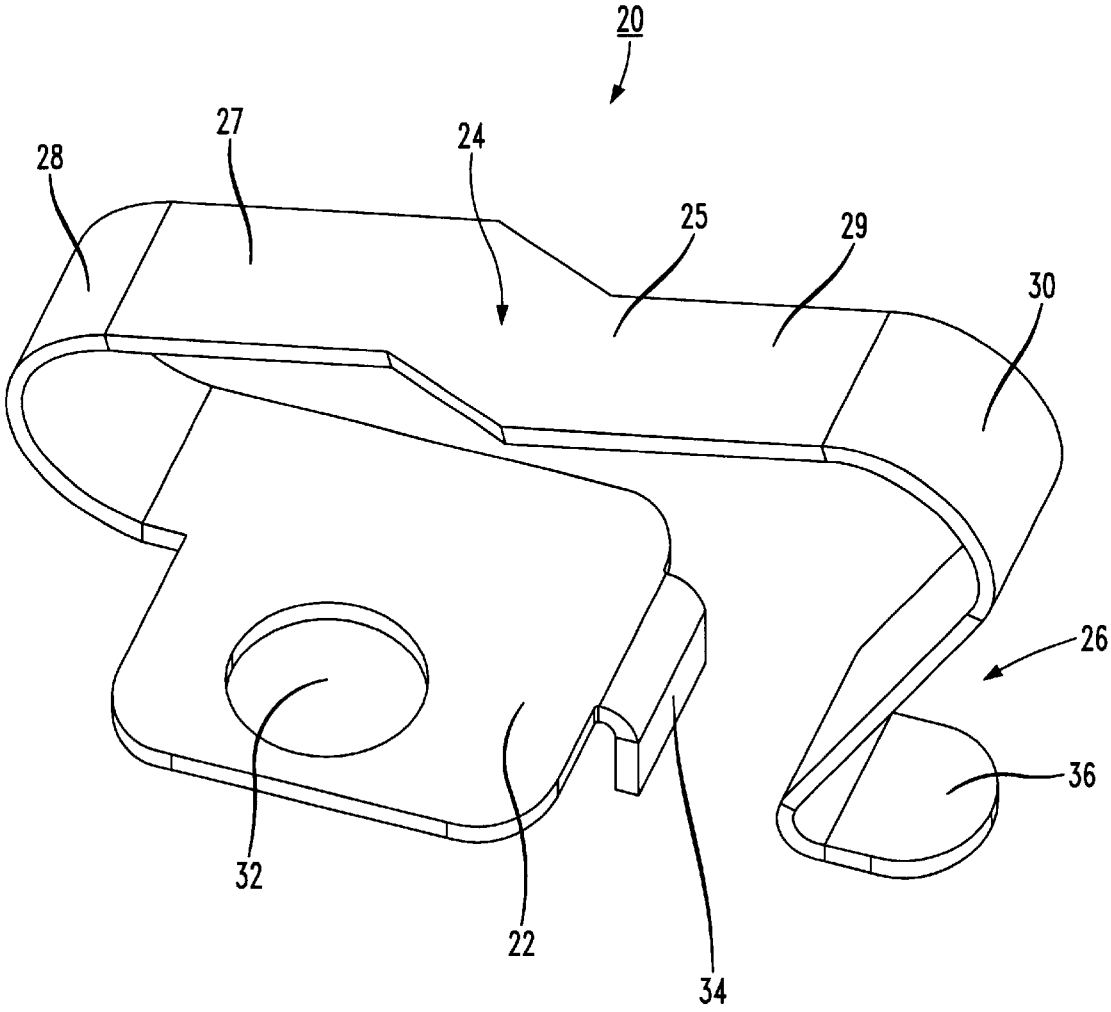
FIG. 3 is an isometric view of the ground clip used in the face plate assembly shown in FIG. 2.

With reference to FIG. 3, the exemplary ground clip 20 is formed of an electrically conductive material, and is preferably made of stainless steel. The ground clip 20 includes a base member 22, a contact surface 24 and a free end 26. A first elbow 28 connects base member 22 to contact surface 24, and a second elbow 30 connects contact member 24 to the free end 26 of ground clip 20. The contact surface includes first and second portions 27, 29 that are joined by a Z-bend 25.

A through hole 32 is provided in base member 22 for receiving a fastener to secure the ground clip 20 to face plate 60. Suitable fastening devices include, but are not limited to, rivets, threaded fasteners, or equivalent structures that provide a secure connection between the ground clip 20 and face plate 60.

A downward projecting first alignment tab 34 extends from base member 22, and a second alignment tab 36 is provided at the free end of ground clip 20. The first and second tabs 34, 36 are received in face plate 60 to properly align the ground clip 20.

Figure 4:
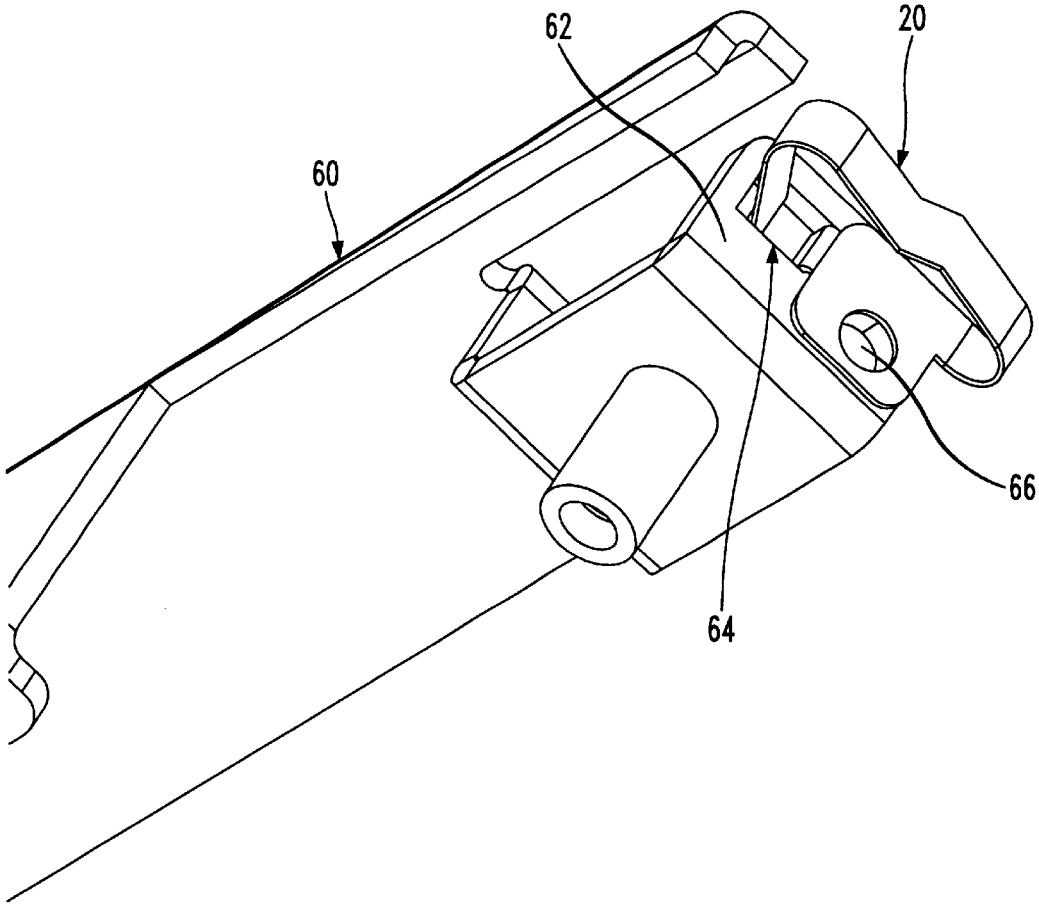
FIG. 4 is an isometric view of the ground clip shown in FIG. 3, secured to a face plate, without a fastener.

As shown in FIG. 4, face plate 60 is provided with a flange 62, on which ground clip 20 is mounted. Flange 62 includes a cutout 64 that receives first and second alignment tabs 34, 36. A through hole 66 is also provided in flange 62. When ground clip 20 is properly positioned on flange 62, tabs 34 and 36 are captured in cutout 64, and through holes 32 and 66 are aligned for receiving a fastener 68. The face plate assembly 10 may also include a circuit pack latch 70 for securing, the assembly in a subrack 100. The latch 70 may be coupled to either the top or bottom of face plate 60.

Figure 5:
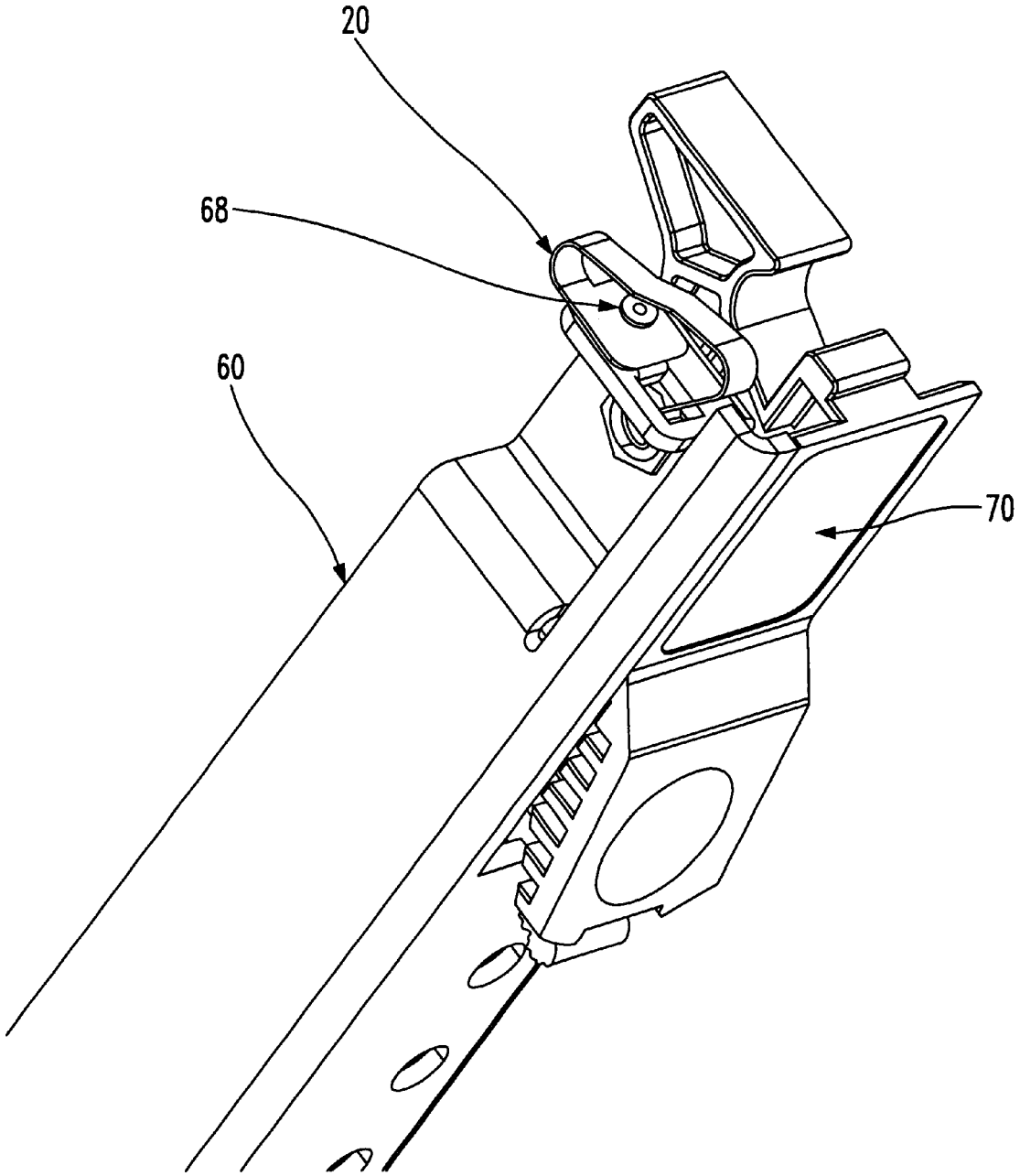
FIG. 5 is an isometric view of the ground clip shown in FIG. 4, secured to a plate with a fastener.

The anti-rotation ground clip 20 is assembled to flange 62 by inserting the free end 26 of the ground clip 20 through cutout 64 so that the second alignment tab 36 is captured within cutout 64. The base 22 of the ground clip 20 is then pressed flush against flange 62, causing first alignment tab 36 to be received in cutout 64. In the exemplary embodiment shown, cutout 64 has a rectangular shape and includes a width that is substantially complementary to the width of first and second alignment tabs 34, 36. Thus, when alignment tabs 34, 36 are received in cutout 64, ground clip 20 is fixed in position. The first and second alignment tabs 34, 36 are also self-aligning features of the ground clip, that locate through hole 32 of ground clip 20 with respect to through hole 66 of the flange 62. After positioning the ground clip 20 on flange 62, a fastener 68, shown in FIG. 5, is used to secure the components together.

Figure 6:
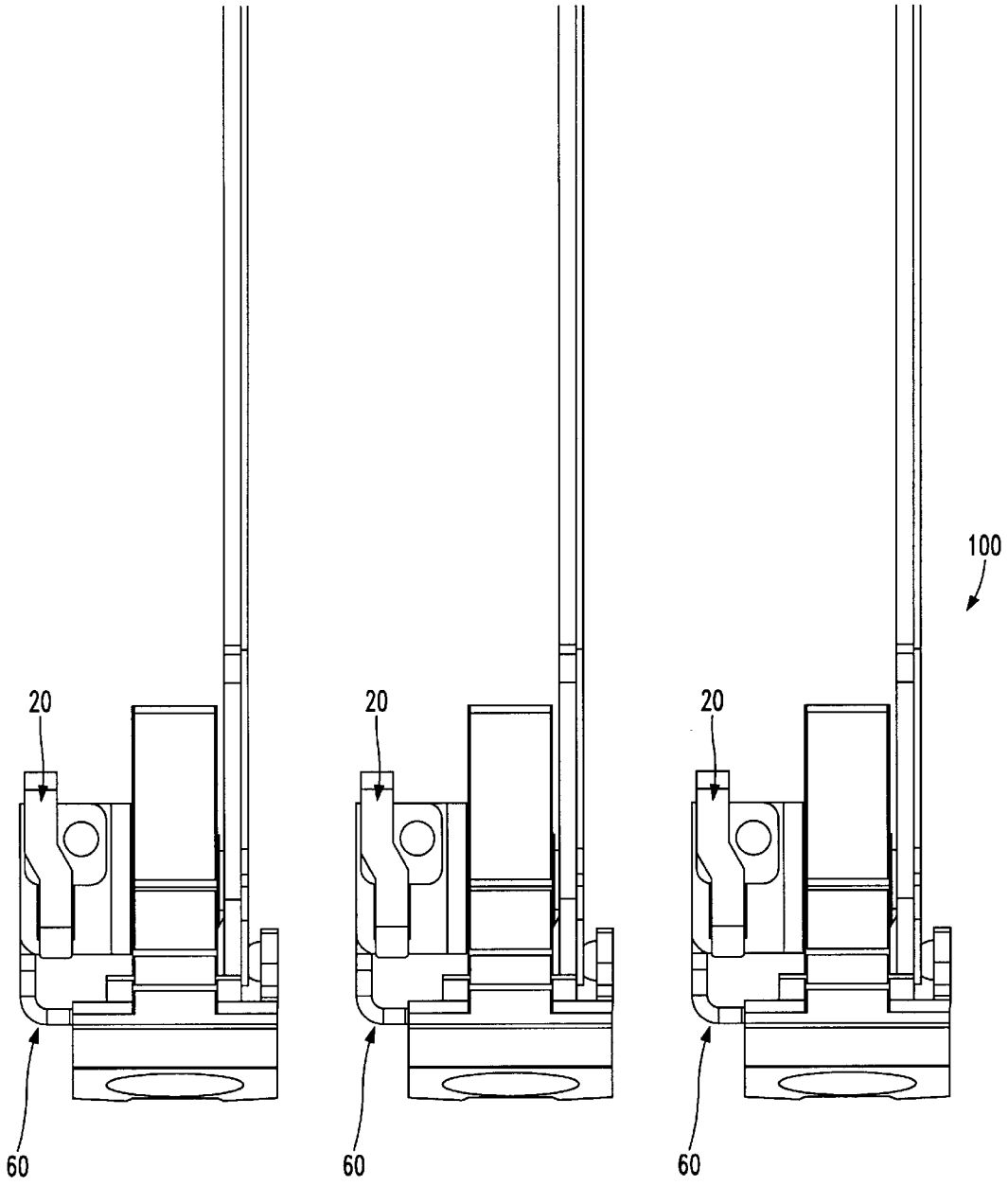
FIG. 6 is a top plan view of several face plate assemblies in accordance with the invention, mounted in a subrack.

FIG. 6 shows a top plan view of a subrack assembly, including a plurality of discrete face plate assemblies. As shown, the free end 26 of each ground clip 20 is captured within the cutout 64 provided in the face plate 60 of each assembly.

A number of advantages are achieved in accordance with the invention. The ground clip 20 is self-aligning which makes it easier to assemble and reduces scrap rates. The Z-bend 25 provided in the contact surface 24 of ground clip

20 allows ample access to through hole 32 to facilitate insertion of a fastener 68, while free end 26 is captured in the face plate 60 to prevent the clip 20 from rotating. Thus, problems associated with previous constructions as a result of misaligned and over traveled ground clips 20, such as snagging and deformation, are avoided. Further, the ground clip 20 still only requires one fastener, so that the aforementioned advantages are achieved without increasing the time or expense of manufacture and assembly.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A face plate assembly comprising:

a ground clip having a base member, a contact surface formed of sheet material, the sheet material being substantially flat to define a plane having a z-bend formed therein, and a free end;

a circuit pack; and a face plate coupled to said circuit pack, said face plate having a flange for mounting said ground clip, said flange including a cutout, wherein said free end of said ground clip is received in said cutout for preventing rotation of said ground clip.

2. The assembly of claim 1 wherein said ground clip has a first elbow connecting said base to said contact surface, and a second elbow connecting said contact surface to said free end.

3. The assembly of claim 1 wherein said ground clip includes first and second alignment tabs.

4. The assembly of claim 1 wherein said free end of said ground clip includes said second alignment tab.

5. The assembly of claim 3 wherein said first alignment tab is received in said cutout.

6. The assembly of claim 3 further comprising a circuit pack latch.

7. The assembly of claim 3 wherein said base member said first elbow, said contact surface, and said second elbow are serially connected.

8. The assembly of claim 3 wherein each of said circuit pack latch and said ground clip are located on at least one of a top and bottom of said face plate.

9. A ground clip for an electrical device comprising:

a base member;

a substantially planar contact surface formed of sheet material and having a Z-bend defined therein;

a free end;

a first elbow connecting said base to said contact surface; and a second elbow connecting said contact surface to said free end, said base member said first elbow, said contact surface, and said second elbow being serially connected, wherein the base member includes a first alignment tab.

10. The ground clip of claim 9 wherein free end includes a second alignment tab.

11. The ground clip of claim 9 wherein the base member includes a through hole for receiving a fastener.

12. The ground clip of claim 11 wherein the contact surface has first and second portions, said first portion having a longitudinal axis that is radially spaced from an axis of the through hole.

13. A ground clip for an electrical device comprising:

a base member;

a substantially planar contact surface formed of sheet material and having a Z-bend defined therein;

a free end;

a first elbow connecting said base to said contact surface; and a second elbow connecting said contact surface to said free end, said base member said first elbow, said contact surface, and said second elbow being serially connected.

* * * * *